US011098441B2

(12) United States Patent
Nohara

(10) Patent No.: US 11,098,441 B2
(45) Date of Patent: Aug. 24, 2021

(54) COOL-FEELING FIBER FABRIC AND METHOD FOR PRODUCING SAME

(71) Applicant: AS CORPORATION, Osaka (JP)

(72) Inventor: Shigeru Nohara, Osaka (JP)

(73) Assignee: AS CORPORATION, Osaka (JP)

( * ) Notice: Subject to any disclaimer, the term of this patent is extended or adjusted under 35 U.S.C. 154(b) by 68 days.

(21) Appl. No.: 15/725,944

(22) Filed: Oct. 5, 2017

(65) Prior Publication Data

US 2018/0030647 A1 Feb. 1, 2018

Related U.S. Application Data

(62) Division of application No. 14/438,502, filed as application No. PCT/JP2012/006879 on Oct. 26, 2012, now abandoned.

(51) Int. Cl.

| | |
|---|---|
| ***D06M 11/46*** | (2006.01) |
| ***D06M 23/08*** | (2006.01) |
| ***D06M 11/77*** | (2006.01) |
| ***D06M 23/00*** | (2006.01) |
| *D06M 11/44* | (2006.01) |
| *D06M 15/263* | (2006.01) |

(52) U.S. Cl.

CPC ..... *D06M 11/46* (2013.01); *D06M 11/77* (2013.01); *D06M 23/00* (2013.01); *D06M 23/08* (2013.01); *D06M 11/44* (2013.01); *D06M 15/263* (2013.01); *D06M 2200/25* (2013.01); *Y10T 442/2598* (2015.04)

(58) Field of Classification Search

CPC ..... D06M 11/46
USPC ..... 427/376.1
See application file for complete search history.

(56) References Cited

U.S. PATENT DOCUMENTS

2005/0037057 A1* 2/2005 Schuette ..... A61K 33/38 424/443

FOREIGN PATENT DOCUMENTS

| | | |
|---|---|---|
| JP | 4-289268 | * 10/1992 |
| JP | 2006348414 | * 12/2006 |

OTHER PUBLICATIONS

Yang, Studying the Mechanisms of Titanium Dioxide as Ultraviolet-Blocking additive for Films and Fabrics by an Improved Scheme, Journal of Applied Polymer Science, vol. 92, p. 3201-3210 (2004) (Year: 2004).*

* cited by examiner

*Primary Examiner* — Tabatha L Penny
(74) *Attorney, Agent, or Firm* — Stephen J. Weyer, Esq.; Stites & Harbison, PLLC

(57) ABSTRACT

A method is provided for producing a fiber fabric by preparing a finishing agent treatment liquid having a mixture of first and second particles of titanium oxide having a particle diameter of 150 to 200 nm and 1 to 5 μm respectively, a silver zeolite and a binder resin, immersing a fiber fabric in the finishing agent, thermal drying the fiber fabric and subjecting the fiber fabric to heat treatment to allow the finishing agent to adhere to the fiber fabric.

2 Claims, 1 Drawing Sheet

COOL-FEELING FIBER FABRIC AND METHOD FOR PRODUCING SAME

CROSS REFERENCE TO PRIOR APPLICATION

This application is a divisional of U.S. patent application Ser. No. 14/438,502 filed on Apr. 24, 2015, herein incorporated by reference.

TECHNICAL FIELD

The present invention relates to a cool-feeling fiber fabric that achieves effective diffuse reflection of ultraviolet and infrared rays of sunlight to inhibit entry of heat from the outside, and a method for producing the same.

BACKGROUND ART

In recent years, there have been increased natural disasters caused by abnormal climate associated with the rise in atmospheric temperature or seawater temperature due to global warming impact, which leads to growing concerns about environmental destruction and harmful effects on the ecosystem. Especially, since the nuclear power plant accident due to the earthquake and tsunami causes shutdown of a plurality of nuclear power plants to incur power shortages, so that the energy problems have developed into a major social issue. Due to such electrical affairs, power-saving measures have been considered to be a top priority. For such measures, some campaigns have been advanced, such as encouragement of shortening of air-conditioner running time or wearing lighter clothes during working hours to reduce use of air conditioners in summer (so-called "Cool Biz"), and promotion of reducing use of air conditioners at homes for controlling temperatures by clothes to be worn (so-called "Home Eco").

Conventionally, it is known that in the housing-related fields, cooling effects are provided by shielding against heat energy from sunlight with use of heat-shielding roofs, heat-shielding walls, heat-shielding sheets, heat-shielding curtains or the like. On the other hand, in the field of clothing, there are proposed various methods of producing a fiber fabric with refreshing feeling. For example, there are known a method in which a fiber with high water absorptivity such as rayon or cotton is employed on the skin side of clothing to let the sweat from human body out of the clothing; and a method in which a fiber with high heat conductivity is employed on the skin side, or a resin containing a substance with high heat conductivity is printed on the back surface of a fiber fabric, so that the body heat is removed and released out of the body. However, feeling hot in summer is mainly attributed to the rise in temperature caused by absorption of sunlight by clothes or human bodies. Therefore the methods as described above cannot achieve good refreshing feeling.

As another method for providing a heat shielding effect on clothing, there has been proposed a method in which a dye for dyeing clothing fibers itself is provided with a heat shielding effect to improve a heat shielding property of the clothing made of a material colored with the dye (see, for example, Patent Documents 1 and 2).

PRIOR ART DOCUMENT

Patent Documents

Patent Document 1: Japanese Patent Laid-open Publication No. 2000-80319

Patent Document 2: WO 2009/118419

SUMMARY OF THE INVENTION

Problems to be Solved by the Invention

However, in the case where the dye itself is provided with a heat shielding effect, a fiber material to be used and a dye for dyeing the fiber material need to be selected in accordance with the fiber composition. Especially, there is a problem that, when a wide variety of materials are used, highly complex and burdensome steps are required, such as two bath dyeing or three bath dyeing. Further, variation of quality may occur depending on the concentration of a dye used. It is problematic that a lightly-colored or white fiber fabric, i.e. a fiber fabric with little amount of a dye required is obviously poorer in the heat shielding effect, although cloth which is dyed in a high concentration, i.e. a so-called deeply-colored fiber fabric may be higher in the effect.

For the present invention, research and development has been made in the aim of solving the problems as described above. An object of the present invention is to provide a cool-feeling fiber fabric that gives excellent refreshing feeling by suppressing absorption of ultraviolet and infrared rays of sunlight while attaining efficient diffuse reflection in all color tone (white-light color-medium color-deep color) and chroma (red-blue-yellow-green), the fiber fabric being applicable to a number of materials such as cotton, polyester, wool, nylon and rayon. Another object of the present invention is to provide a cool-feeling fiber fabric having antibacterial and deodorizing performance, and a method for producing the fiber fabric.

Solutions to the Problems

In the aim of solving the problems and achieving the above objects, the present invention provides a cool-feeling fiber fabric having ultrafine particles to reflect electromagnetic waves in an ultraviolet wavelength region, fine particles to reflect electromagnetic waves in an infrared region, and a binder resin, wherein the ultrafine particles and the fine particles are firmly adhered to the fiber fabric with the binder resin. Preferably, the ultrafine particles to reflect electromagnetic waves in an ultraviolet wavelength region have a particle diameter of 150 to 200 nm, and the fine particles to reflect electromagnetic waves in an infrared region have a particle diameter of 1 to 5 μm.

The ultrafine particles and the fine particles are preferably titanium oxide.

According to the above, there is achieved a cool-feeling fiber fabric that gives excellent refreshing feeling by suppressing absorption of ultraviolet and infrared rays of sunlight with efficient diffuse reflection of the rays.

In addition, preferably a mixture of the ultrafine particles of titanium oxide and the fine particles of titanium oxide is adhered to the fiber fabric in a ratio of 5 to 10% owf based on the weight of the fiber fabric; silver zeolite is adhered to the fiber fabric in a ratio of 0.03 to 1% owf based on the weight of the fiber fabric; and the binder resin is adhered to the fiber fabric in a ratio of 3 to 5% owf based on the weight of the fiber fabric.

According to the above, there is provided a cool-feeling fiber fabric having not only refreshing feeling but also antibacterial and deodorizing performance.

Further, the present invention also provides a method for producing a cool-feeling fiber fabric, the method including the steps of: preparing a finishing agent treatment liquid containing a mixture of ultrafine particles of titanium oxide to reflect electromagnetic waves in an ultraviolet wavelength region and fine particles of titanium oxide to reflect electromagnetic waves in an infrared region, silver zeolite, and a binder resin; immersing a fiber fabric in the prepared finishing agent treatment liquid; thermally drying the fiber fabric; and subjecting the fiber fabric to a heat treatment to allow the titanium oxide mixture and the silver zeolite to be firmly adhered to the fiber fabric.

Effects of the Invention

In the present invention, the mixture of the ultrafine particles to reflect electromagnetic waves of sunlight in an ultraviolet region, which are harmful to the human skin or the like, and the fine particles to reflect electromagnetic waves in an infrared wavelength region, which is called heat ray area, is firmly adhered to the fiber fabric with the binder resin. Thus, the invention attains efficient diffuse reflection of ultraviolet rays and infrared rays to block the rays, so that the temperature rise can be suppressed.

The invention uses ultrafine particles having a particle diameter of 150 to 200 nm and fine particles having a particle diameter of 1 to 5 μm, so that the electromagnetic waves in the ultraviolet region and the electromagnetic waves in the infrared region can be reflected most effectively. Thus, the resulting cool-feeling fiber fabric has highly excellent shielding property and therefore can be used for various articles of clothing. Additionally, since the ultrafine particles and the fine particles are titanium oxide, sufficient sunlight shielding can be achieved. In the invention, the amounts of the components, i.e. the titanium oxide mixture, the silver zeolite, and the acrylic resin binder, each adhered to the fiber fabric, are 5 to 10% owf, 0.03 to 1% owf, and 3 to 5% owf, respectively, and the amounts are critically specified. Accordingly, the components are interrelated one another to reflect ultraviolet and infrared rays, while exerting deodorizing and antibacterial effects over a long period of time, and additionally the infrared reflection and radiation effects allow for reflection of human body-derived far infrared heat in winter, which is effective at increasing the temperature inside clothes.

The method for producing a cool-feeling fiber fabric of the present invention includes the steps of: preparing a finishing agent treatment liquid containing a mixture of ultrafine particles of titanium oxide to reflect electromagnetic waves in an ultraviolet wavelength region and fine particles of titanium oxide to reflect electromagnetic waves in an infrared region, silver zeolite, and a binder resin; immersing a fiber fabric in the prepared finishing agent treatment liquid; thermally drying the fiber fabric; and subjecting the fiber fabric to a heat treatment to allow the titanium oxide mixture and the silver zeolite to be firmly adhered to the fiber fabric. Thus, by immersing the fiber fabric in the finishing treatment liquid containing the ultrafine particles and the fine particles, the fine particles with a particle diameter of 1 to 5 μm and the ultrafine particles with a particle diameter of 150 to 200 nm can be evenly and uniformly adhered to the fiber fabric, and by thermal drying, the ultrafine particles and the fine particles are more firmly adhered to each other, so that a cool-feeling fiber fabric which is improved in durability of the shielding effect can be easily obtained.

EMBODIMENTS OF THE INVENTION

Figure 1:
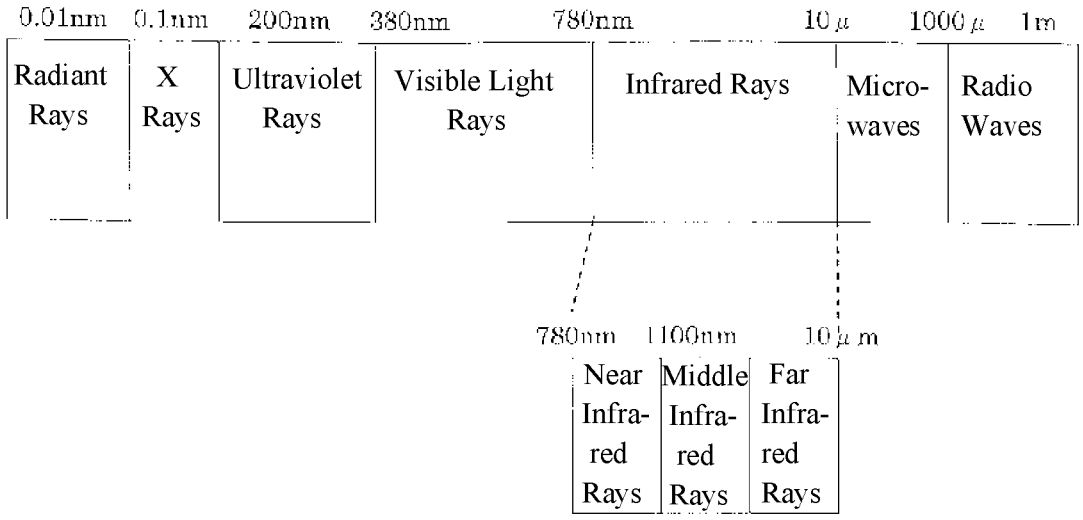
FIG. 1 is a view showing electromagnetic wave analysis of sunlight.

The following will describe embodiments of the cool-feeling fiber fabric according to the present invention and the production method therefor.

The sunlight energy is composed of about 50% infrared rays, 47% visible light rays, and finally 3% ultraviolet rays. It is said that the electromagnetic waves in the infrared wavelength region are particularly related to heat, while the electromagnetic waves in the visible light or ultraviolet wavelength regions are not involved in heat. The cool-feeling fiber fabric according to the embodiment suppresses absorption of the radiant rays (infrared rays) of sunlight while attaining efficient reflection of such rays.

Based on analysis of wavelength regions, the electromagnetic waves of sunlight are classified into radiant rays, X rays, ultraviolet rays, visible light rays, infrared rays, microwaves, and radio waves, etc. For the electromagnetic waves in the ultraviolet region, which are harmful to the human skin etc., and the electromagnetic waves in the infrared wavelength region, which is called heat ray area, the cool-feeling fiber fabric uses titanium oxide in the form of mixture of ultrafine particles and fine particles, and thus allows for efficient diffuse reflection of ultraviolet rays and infrared rays.

Based on an inference from the relation between particle diameter and optical property, the inventors have found that the infrared shielding effect and the ultraviolet shielding effect are obtained by the application of MIE scattering theory such that particles having a diameter which is about half of a wavelength of light (electromagnetic waves) can most efficiently cause diffuse reflection of electromagnetic waves having such a wavelength.

Particles having an extremely small size as compared to the wavelength of the target electromagnetic wave group cause scattering of the Rayleigh scattering region and thus will be very poor in light scattering effect, while particles having an extremely large size cause scattering of the geometric region and thus will also be very poor in the scattering effect. Accordingly, it is desirable that the particles for shielding against ultraviolet rays be ultrafine particles of titanium oxide with a particle diameter of 150 to 200 nm, and the particles for shielding against infrared rays be fine particles of titanium oxide with a particle diameter of 1 to 5 μm. When the particle diameter is 150 nm or smaller, such particles have considerably decreased dispersibility in a liquid due to increased cohesive force, and are deteriorated in ability to reflect light of the electromagnetic wave group in the ultraviolet wavelength region, thus being unsuitable. When the particle diameter is larger than 200 nm, the electromagnetic waves reflected by such particles are those with wavelengths of the visible light region, so that the light reflectivity of the particles is reduced. Accordingly, the suitable particle diameter is 150 to 200 nm as mentioned above.

When the particle diameter of the titanium oxide is larger than 5 μm, the resulting finished fiber fabric has a coarse texture and rough feeling, which is undesirable. Additionally, from the viewpoint of the resistance to laundry, excessively large particle size causes the titanium oxide to be detached from the fiber fabric due to external pressure or other physical actions, resulting in loss of effectiveness. Therefore, the particle diameters of the titanium oxide are suitably in the range of 150 to 200 nm and the range of 1 to 5 μm as mentioned above.

Examples of the titanium oxide include those of three types with different crystal structures, that is, rutile type (tetragonal high-temperature type), anatase type (tetragonal low-temperature type), and brookite type (orthorhombic type). Optimally, the titanium oxide of rutile type is used because it is most stable from the physical and chemical viewpoints. The ratio between the ultrafine particles and the fine particles in the mixture is suitably in the range of 30:70 to 35:65. When the ratio is outside this range, it is unsuitable because the ultraviolet and infrared shielding factors are decreased. The amount of the titanium oxide adhered to the fiber fabric is suitably 5 to 10% owf.

Among ultraviolet rays, those called ultraviolet C with wavelengths of 200 to 290 nm rarely reach the earth surface because they are blocked or absorbed by the ozone layer in the upper atmosphere of the earth. Thus, the present invention targets the group of the electromagnetic waves with wavelengths of 290 to 320 nm, called ultraviolet B, and those with wavelengths of 320 to 380 nm, called ultraviolet A. With regard to infrared rays, it is said that there is a deep relation between the near infrared rays with wavelengths of 780 to 1100 nm and organisms. The electromagnetic wave group in a wavelength region of 4 to 14 μm, which is said to be a wavelength region for organic growing, and the electromagnetic wave group having heat energy in total are diffusely reflected.

For the fiber fabric used in the present invention, it is possible to use natural fibers such as cotton, hemp, silk, and wool; regenerated fibers such as rayon, cupra, and polynosic fibers; semi-synthetic fibers such as acetate, triacetate, and promix fibers; and synthetic fibers such as nylon, polyester, acryl, polyurethane, polypropylene, and polyvinyl chloride fibers, depending on the type of binder resin used.

The binder resin for use in the cool-feeling fiber fabric according to the embodiment may be any of water-resistant resins. Examples thereof may include acrylic resins, urethane resins, vinylon chloride resins, and vinyl acetate resins. Any of binder resins which provide high film strength and adhesiveness may be used. The binder resin is preferably incorporated in an amount of 30 to 50 g/L. The amount of the binder adhered to the fiber fabric is suitably 3 to 5% owf.

The silver zeolite for use in the cool-feeling fiber fabric according to the embodiment is in the form of fine particles in which silver is deposited, through ion exchange, on zeolite which is porous aluminosilicate including an alkali or alkaline earth element. The silver zeolite exerts deodorizing effects by attracting odor components into fine pores of zeolite and decomposing the odor components through neutralization in the fine pores by ion exchange. The amount of the silver zeolite adhered to the fiber fabric is suitably 0.03 to 1% owf.

EXAMPLES

Hereinafter, the present invention will be described in more detail by way of examples. Measurement of infrared shielding of the fiber fabrics in Examples 1 to 4 and Comparative Examples 1 to 5 was performed in the following manner.

The measurement was carried out by Unitika Garments Technology & Research Laboratories Ltd. as a public inspection organization, using a measurement apparatus UV-3100PC available from Shimadzu Corporation, and Integrating Sphere Attachment ISR-3100 for measuring the amount of light, with an integrating sphere having an inner diameter of 60 mm. The measurement wavelength range was 780 nm to 10 μm. A standard white board of barium sulfate was used.

Figure 2:
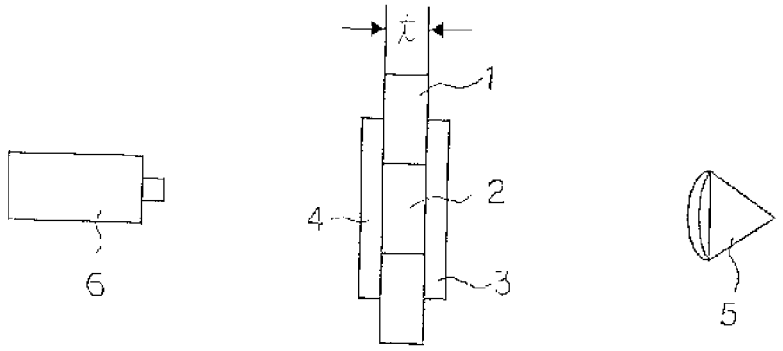
FIG. 2 is a simplified lateral view of an apparatus for measurement of infrared heat shielding effectiveness.

In the measurement apparatus, as shown in FIG. 2, a heat insulation board 1 (styrene foam) with a size of 8×8×0.7 cm was provided with a hole 2, and a fiber fabric sample 3 was attached on one side of the board, while a black body (black sheet) 4 was attached on the back side thereof with thickness t (0.7 cm). An infrared lamp 5 was used to irradiate the front surface side of the fiber fabric sample 3 with light.

In this case, the surface temperature of the black body 4 on the back side was measured over time with using a thermograph 6 so that the maximum temperature in the temperature difference of the average temperature of the fiber fabric on the front surface side of the hole could be plotted as thermographic measurements. The irradiation time of the infrared lamp 5 was 8 minutes in Example 1, and 5 minutes in Examples 2 to 4.

In the measurement apparatus, the distance between the infrared lamp 5 and the fiber fabric sample 3 was about 50 cm, and the infrared lamp used was Infrared drying light bulb (IR100V250WRHE) produced from Toshiba Lighting & Technology Corporation, with a voltage of 90 V applied.

Example 1

One hundred litters (L) of a total finishing agent treatment liquid is prepared which is composed of: 7 L of a finishing agent solution containing 25 to 30% titanium oxide in which the ratio of ultrafine particles to fine particles is 30:70 to 35:65, 0.3% methanol and 0.3% zinc oxide; 3.5 L of an acrylate compound binder solution; 0.1 L of silver zeolite; and 89.4 L of water. The prepared liquid is fed into a finishing bath. A plating jersey stitch fiber fabric made of 55% polyester and 45% rayon is immersed in the finishing bath to carry out padding process, thereby allowing the finishing agent to be adhered to the fiber fabric, followed by drying at 105° C. for 2 minutes. The resultant is further subjected to a heat treatment at 140° C. for 2 minutes, so that the finishing agent components are firmly adhered to the fiber fabric. Thus, a cool-feeling fiber fabric was obtained. White and black plating jersey stitch fiber fabrics, and a white rib stitch fiber fabric of the same composition were subjected to the finishing.

Example 2

One hundred litters (L) of a total finishing agent treatment liquid is prepared which is composed of: 10 L of a finishing agent solution containing 25 to 30% titanium oxide in which the ratio of ultrafine particles to fine particles is 30:70 to 35:65, 0.3% methanol and 0.3% zinc oxide; 5 L of an acrylate compound binder solution; 0.1 L of silver zeolite; and 84.9 L of water. The prepared liquid is fed into a finishing bath. A plating jersey stitch fiber fabric made of 55% polyester and 45% rayon is immersed in the finishing bath to carry out padding process, thereby allowing the finishing agent to be adhered to the fiber fabric, followed by drying at 105° C. for 2 minutes. The resultant is further subjected to a heat treatment at 140° C. for 2 minutes, so that the finishing agent components are firmly adhered to the fiber fabric. Thus, a cool-feeling fiber fabric was obtained.

Pink and black plating jersey stitch fiber fabrics, and a white rib stitch fiber fabric of the same composition were subjected to the finishing.

Example 3

One hundred litters (L) of a total finishing agent treatment liquid is prepared which is composed of: 7 L of a finishing agent solution containing 25 to 30% titanium oxide in which the ratio of ultrafine particles to fine particles is 30:70 to 35:65, 0.3% methanol and 0.3% zinc oxide; 3.5 L of an acrylate compound binder solution; 0.1 L of silver zeolite; and 89.4 L of water. The prepared liquid is fed into a finishing bath. Each of white, gray and navy-blue hard twist rib stitch fiber fabrics made of 44% cotton, 39% rayon and 17% polyester is immersed in the finishing bath to carry out padding process, thereby allowing the finishing agent to be adhered to the fiber fabric, followed by drying at 105° C. for 2 minutes. The resultant is further subjected to a heat treatment at 140° C. for 2 minutes, so that the finishing agent components are firmly adhered to the fiber fabric. Thus, a cool-feeling fiber fabric was obtained.

Example 4

One hundred litters (L) of a total finishing agent treatment liquid is prepared which is composed of: 7 L of a finishing agent solution containing 25 to 30% titanium oxide in which the ratio of ultrafine particles to fine particles is 30:70 to 35:65, 0.3% methanol and 0.3% zinc oxide; 3.5 L of an acrylate compound binder solution; 0.1 L of silver zeolite; and 89.4 L of water. The prepared liquid is fed into a finishing bath. A beige drop-needle stitch fiber fabric made of 55% polyester and 45% rayon is immersed in the finishing bath to carry out padding process, thereby allowing the finishing agent to be adhered to the fiber fabric, followed by drying at 105° C. for 2 minutes. The resultant is further subjected to a heat treatment at 140° C. for 2 minutes, so that the finishing agent components are firmly adhered to the fiber fabric. Thus, a cool-feeling fiber fabric was obtained.

Comparative Example 1

A heat-shielding special dye-based disperse dye and a reactive dye were used to dye a plating jersey stitch fiber fabric made of 55% polyester and 45% rayon, so that the fiber fabric was dyed with black in the same color tone as that in Example 1, while a regular disperse dye and a regular reactive dye, each of common type, were used for dyeing of the fiber fabric to obtain a black fiber fabric in the same tone as above.

Comparative Example 2

A heat-shielding special dye-based disperse dye and a reactive dye were used to dye a rib stitch fiber fabric made of 55% polyester and 45% rayon, so that the fiber fabric was dyed with black in the same color tone as that in Example 1, while a regular disperse dye and a regular reactive dye, each of common type, were used for dyeing of the fiber fabric to obtain a black fiber fabric in the same tone as above.

Comparative Example 3

A heat-shielding special dye-based disperse dye and a reactive dye were used to dye a drop-needle stitch fiber fabric made of 55% polyester and 45% rayon, so that the fiber fabric was dyed with black in the same color tone as that in Example 1, while a regular disperse dye and a regular reactive dye, each of common type, were used for dyeing of the fiber fabric to obtain a black fiber fabric in the same tone as above.

Comparative Example 4

A heat-shielding special dye-based disperse dye and a reactive dye were used to dye a plating jersey stitch fiber fabric made of 55% polyester and 45% rayon, so that the fiber fabric was dyed with pink in the same color tone as that in Example 2, while a regular disperse dye and a regular reactive dye, each of common type, were used for dyeing of the fiber fabric to obtain a pink fiber fabric in the same tone as above.

Comparative Example 5

A heat-shielding special dye-based disperse dye and a reactive dye were used to dye hard twist rib stitch fiber fabrics made of 44% cotton, 39% rayon and 17% polyester, so that the fiber fabrics were dyed with gray and pink, respectively, in the same color tone as those in Example 3, while a regular disperse dye and a regular reactive dye, each of common type, were used for dyeing of the fiber fabrics to obtain gray and pink fiber fabrics in the same tone as above.

For each of the fiber fabrics of Examples 1 to 4 and Comparative Examples 1 to 5 obtained in the above manner, infrared ray irradiation was performed to measure their shielding performance. The results are shown in Table 1.

TABLE 1

| | Finished fabric | Unfinished fabric | Δt | Evaluation |
|---|---|---|---|---|
| Example 1 | | | | |
| Plating jersey stitch White | 49.5° C. | 51.3° C. | 1.8° C. | ○ |
| Black | 45.0° C. | 47.6° C. | 2.6° C. | ⊙ |
| Rib stitch White | 44.2° C. | 45.8° C. | 1.6° C. | ○ |
| Example 2 | | | | |
| Plating jersey stitch Pink | 35.8° C. | 38.5° C. | 2.7° C. | ⊙ |
| Black | 36.0° C. | 38.5° C. | 2.5° C. | ⊙ |
| Rib stitch White | 37.1° C. | 39.0° C. | 1.9° C. | ○ |
| Example 3 | | | | |
| Hard twist rib stitch White | 34.0° C. | 35.4° C. | 1.4° C. | ○ |
| Gray | 37.7° C. | 38.9° C. | 1.2° C. | ○ |
| Navy-blue | 36.9° C. | 37.4° C. | 0.5° C. | Δ |
| Example 4 | | | | |
| Drop-needle stitch Beige | 43.1° C. | 43.6° C. | 0.5° C. | Δ |
| Comparative Example 1 | Heat-shielding dye | Regular dye | | |
| Plating jersey stitch Black | 37.3° C. | 39.2° C. | 1.9° C. | ○ |
| Comparative Example 2 | | | | |
| Rib stitch Black | 38.8° C. | 39.9° C. | 1.1° C. | ○ |
| Comparative Example 3 | | | | |
| Drop-needle stitch Black | 40.4° C. | 40.6° C. | 0.2° C. | X |
| Comparative Example 4 | | | | |
| Plating jersey stitch Pink | 39.6° C. | 39.8° C. | 0.2° C. | X |

TABLE 1-continued

| | Finished fabric | Unfinished fabric | Δt | Evaluation |
|---|---|---|---|---|
| Comparative Example 5 | | | | |
| Hard twist rib stitch Gray | 42.6° C. | 42.7° C. | 0.1° C. | X |
| Pink | 40.9° C. | 40.9° C. | ±0° C. | X |

The evaluation criteria are as follows:

⊙: Difference in temperature between finished and unfinished (blank) fabrics is 2° C. or higher;

○: Difference in temperature therebetween is 1° C. or higher but less than 2° C.;

Δ: Difference in temperature therebetween is 0.5° C. or higher but less than 1° C.; and x: Difference in temperature therebetween is less than 0.5° C.

Next, ultraviolet shielding effectiveness was measured in Examples 5 and 6. The measurement was carried out in the same manner as the infrared measurement described above, except that an ultraviolet lamp was used as a light source, and the measurement wavelength range was changed to a range of 280 nm to 380 nm. The results are shown in Table 2.

Example 5

One hundred litters (L) of a total finishing agent treatment liquid is prepared which is composed of: 7 L of a finishing agent solution containing 25 to 30% titanium oxide in which the ratio of ultrafine particles to fine particles is 30:70 to 35:65, 0.3% methanol and 0.3% zinc oxide; 3.5 L of an acrylate compound binder solution; 0.1 L of silver zeolite; and 89.4 L of water. The prepared liquid is fed into a finishing bath. A white hard twist rib stitch fiber fabric made of 44% cotton, 39% rayon and 17% polyester is immersed in the finishing bath to carry out padding process, thereby allowing the finishing agent to be adhered to the fiber fabric, followed by drying at 105° C. for 2 minutes. The resultant is further subjected to a heat treatment at 140° C. for 2 minutes, so that the finishing agent components are firmly adhered to the fiber fabric. Thus, a cool-feeling fiber fabric was obtained.

Example 6

One hundred litters (L) of a total finishing agent treatment liquid is prepared which is composed of: 7 L of a finishing agent solution containing 25 to 30% titanium oxide in which the ratio of ultrafine particles to fine particles is 30:70 to 35:65, 0.3% methanol and 0.3% zinc oxide; 3.5 L of an acrylate compound binder solution; 0.1 L of silver zeolite; and 89.4 L of water. The prepared liquid is fed into a finishing bath. A white plating jersey stitch fiber fabric made of 55% polyester and 45% rayon is immersed in the finishing bath to carry out padding process, thereby allowing the finishing agent to be adhered to the fiber fabric, followed by drying at 105° C. for 2 minutes. The resultant is further subjected to a heat treatment at 140° C. for 2 minutes, so that the finishing agent components are firmly adhered to the fiber fabric. Thus, a cool-feeling fiber fabric was obtained.

TABLE 2

| | | Finished fabric | Unfinished fabric | Evaluation |
|---|---|---|---|---|
| Rib stitch White | Ultraviolet shielding factor | 94.7% | 90.0% | ⊙ |
| Plating jersey stitch White | Ultraviolet shielding factor | 91.4% | 90.6% | ○ |

The evaluation criteria are as follows:

⊙: Rate of improvement in the shielding factor is 5% or more;

○: Rate of improvement in the shielding factor is 0.5% or more but less than 5%; and Δ: Rate of improvement in the shielding factor is less than 0.5%.

A fabric having a shielding factor of 90% or more is ranked in the group of excellent shielding factor (rank A). It is observed that the fabric originally having an excellent shielding factor is even further improved in the shielding factor. In view of this, if the present invention is applied to a fabric having a shielding factor of 80 to 90% which is in the group of good shielding factor (rank B) or a fabric having a shielding factor of 50 to 80% which is in a general level (rank C), the shielding factor-improving effect may be further enhanced.

Figure 3:
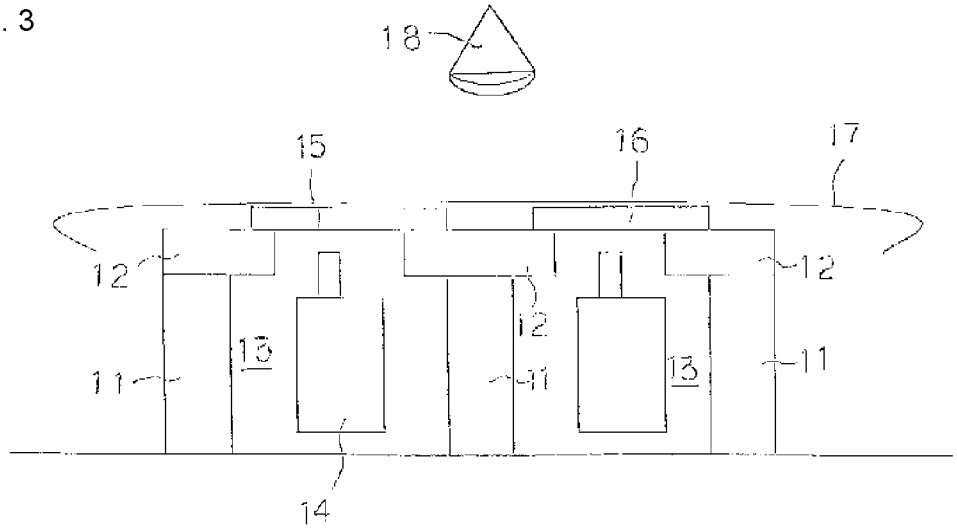
FIG. 3 is a simplified front view showing another example of an apparatus for measurement of infrared heat shielding effectiveness.

FIG. 3 shows an apparatus for measuring fiber fabric temperatures by irradiating an underwear fiber fabric with infrared rays allowed to pass through it. As shown in FIG. 3, three heat insulation boards 11, 11 and 11 are disposed at a prescribed interval, and horizontally-elongated heat insulation boards 12, 12 and 12 are provided on the upper end of the boards 11. A temperature sensor 14 is placed at a space 13 which is surrounded by the heat insulation boards 11 and 12. On the horizontally-elongated heat insulation boards 12, 12 and 12, a finished fabric 15 and an unfinished fabric 16 are placed, which fabrics are covered with a commercially available broadcloth shirt 17, and subjected to infrared-ray irradiation for 20 minutes with an infrared lamp 18 located above the shirt, so that the temperatures of the fiber fabrics through which infrared rays have passed are measured by the temperature sensors 14 positioned about 5-mm directly below the finished fiber fabric 15 or the unfinished fiber fabric 16. This aims at measuring the difference in temperature in a condition close to a state where the fiber fabric is used as underwear. Table 3 shows the results of the test. In the test, the outside air temperature (room temperature) is 27.4° C.

TABLE 3

| | | Finished fabric | Unfinished fabric | Difference Δt |
|---|---|---|---|---|
| Plating jersey stitch | Black | 39.5° C. | 43.8° C. | Δt 4.3° C. |
| Plating jersey stitch | White | 35.4° C. | 38.2° C. | Δt 2.8° C. |

As is clear from Table 3 above, in the simulation of use of the fiber fabric as underwear in a condition of extended irradiation time, it was confirmed that the difference of the temperatures between the finished and unfinished black plating jersey stitch fabrics was Δt 4.3° C., and the difference between the finished and unfinished white plating jersey stitch fabrics was Δt 2.8° C.

Table 4 shows the results of evaluations of antibacterial activity and deodorizing performance in Examples 1 to 6.

TABLE 4

| | Antibacterial activity | Ammonia | Acetic acid | Isovaleric acid |
|---|---|---|---|---|
| Example 1 | ⊙ | ○ | ○ | ⊙ |
| Example 2 | ⊙ | ⊙ | ○ | ⊙ |
| Example 3 | ○ | ○ | Δ | ○ |
| Example 4 | ○ | Δ | Δ | ○ |
| Example 5 | ○ | ○ | ○ | ○ |
| Example 6 | ○ | ○ | ○ | ○ |

As to public inspection organizations, the antibacterial test was carried out by Daiwa Chemical Industries Co., Ltd., and the deodorization test was carried out by Boken Quality Evaluation Institute.

The antibacterial evaluation was performed according to Testing for antibacterial activity, Bacterial culture absorption method (based on JIS L 1902). In this table, the criteria are as follows:

⊙: Bacteriostatic activity value is 4 or more;

○: Bacteriostatic activity value is 2.2 or more, which is acceptable; and x: Bacteriostatic activity value is 2.2 or less, which is rejectable.

The bacteriostatic activity value can be calculated by the following formula:

$$\text{Bacteriostatic activity value}=(Mb-Ma)-(Mc-Mo) \geq 2.2$$

wherein

Mb is the average of common logarithm of viable cell count obtained after incubation for 18 hours on the unfinished fabric;

Ma is the average of common logarithm of viable cell count obtained immediately after inoculation of testing bacteria on the unfinished fabric;

Mc is the average of common logarithm of viable cell count obtained after incubation for 18 hours on the antibacterial finished fabric; and Mo is the average of common logarithm of viable cell count obtained immediately after inoculation of testing bacteria on the antibacterial finished fabric.

The deodorizing efficacy evaluation was performed according to a deodorizing performance test, JAFET standard detergent method, by instrumental analysis and assessment. In the table, the criteria are as follows:

⊙: Decrease rate is 90% or more;

○: Deodorization rate is 80 to 90%;

Δ: Deodorization rate is 70 to 80%, which is acceptable; and x: Deodorization rate is 70% or less, which is rejectable.

The deodorization rate (decrease rate) can be calculated by the following formulae.

$$\text{Ammonia/Acetic acid Decrease rate (\%)}=\{(A-B)/A\}\times 100$$

A is a measurement value of a blank test; and

B is a measurement value of a sample;

$$\text{Isovaleric acid Decrease rate (\%)}=\{(C-D)/C\}\times 100$$

C is a peak area of a blank test; and

D is a peak area of a sample.

The present invention is herein described as above based on embodiments, but is not limited to the above-mentioned examples. It should be understood that various design modifications of the invention are possible as long as the object of the invention can be achieved within the scope of the spirit of the invention.

INDUSTRIAL APPLICABILITY

The cool-feeling fiber fabric according to the present invention is advantageously applicable not only to clothing such as shirts, blouses and dresses, but also to apparel accessories such as hats, gloves and stockings, interior goods such as curtains, lace and blinds, and industrial materials such as sailcloth, cheesecloth and industrial sheets.

The invention claimed is:

1. A method for producing a fiber fabric, the method comprising the steps of:

preparing a finishing agent treatment liquid containing a mixture of first particles of titanium oxide with a particle diameter of 150 to 200 nm to reflect electromagnetic waves in an ultraviolet wavelength region of 290 to 380 nm and second fine particles of titanium oxide with a particle diameter of 1 to 5 μm to reflect electromagnetic waves in an infrared region of 4 to 14 μm, by the application of MIE scattering theory, with the mixture ratio between the first particles and the second particles in the range of 30:70 to 35:65, silver zeolite, and a binder resin;

immersing a fiber fabric in the prepared finishing agent treatment liquid;

thermally drying the fiber fabric; and subjecting the fiber fabric to a heat treatment to allow the titanium oxide mixture and the silver zeolite to be adhered to the fiber fabric.

2. The method of claim 1, wherein said immersing the fiber fabric in the prepared finishing agent treatment liquid comprises a padding process to allow the prepared finishing agent treatment liquid to be adhered to the fiber fabric.

* * * * *